US012256874B1

(12) United States Patent
Al Hamli

(10) Patent No.: US 12,256,874 B1
(45) Date of Patent: Mar. 25, 2025

(54) SCRUBBING DEVICE WITH ADJUSTABLE HEAD

(71) Applicant: Mossab M. M. J. Al Hamli, Salmiya (KW)

(72) Inventor: Mossab M. M. J. Al Hamli, Salmiya (KW)

( * ) Notice: Subject to any disclaimer, the term of this patent is extended or adjusted under 35 U.S.C. 154(b) by 0 days.

(21) Appl. No.: 18/427,909

(22) Filed: Jan. 31, 2024

(51) Int. Cl.

| | |
|---|---|
| ***A47K 7/04*** | (2006.01) |
| ***A46B 5/00*** | (2006.01) |
| ***A46B 13/02*** | (2006.01) |
| ***A46B 17/08*** | (2006.01) |

(52) U.S. Cl.
CPC ..... *A47K 7/043* (2013.01); *A46B 5/0075* (2013.01); *A46B 5/0095* (2013.01); *A46B 13/02* (2013.01); *A46B 17/08* (2013.01); *A46B 2200/1006* (2013.01)

(58) Field of Classification Search
CPC ..... A47K 7/043; A46B 5/0075; A46B 5/0095
See application file for complete search history.

(56) References Cited

U.S. PATENT DOCUMENTS

| | | | | |
|---|---|---|---|---|
| 5,123,768 | A | 6/1992 | Franklin | |
| 5,479,951 | A * | 1/1996 | Denebeim ..... | A46B 5/0075 15/207.2 |
| 6,053,076 | A | 4/2000 | Barnes | |
| D471,365 | S | 3/2003 | Henrie | |
| 7,082,862 | B2 | 8/2006 | Lee | |
| 7,343,837 | B1 | 3/2008 | Domanico et al. | |
| 7,600,287 | B1 | 10/2009 | Moore et al. | |
| 8,695,459 | B2 | 4/2014 | Lee et al. | |

(Continued)

FOREIGN PATENT DOCUMENTS

| | | | |
|---|---|---|---|
| CH | 697607 | B1 | 12/2008 |
| CN | 202044189 | U | 11/2011 |
| GB | 2541254 | A | 2/2017 |

OTHER PUBLICATIONS

"EASACE Long Handle Bath Body Brush & Lotion Applicator for Back Scrubber, Shower Brush with Soft Bristles for Wet or Dry"; printed on Jan. 2, 2024 from https://www.amazon.com/dp/B09SFZBDY7/ref=sspa_dk_detail_2?psc=1&pf_rd_p=f734d1a2-0bf9-4a26-ad34-2e1b969a5a75&pf_rd_r=5G874CDKSFW9BC6CD8VD&pd_rd_wg=WhhxA&pd_rd_w=2bCLq&content-id=amzn1.sym.f734d1a2-0bf9-4a26-ad34-2e1b969a5a75&pd_rd_r=aeffe98b-d9ed-423b-.

(Continued)

*Primary Examiner* — Shay Karls
(74) *Attorney, Agent, or Firm* — Nath, Goldberg & Meyer; Joshua B. Goldberg

(57) ABSTRACT

The scrubbing device with an adjustable head includes a handle portion and a scrubbing head attached to the handle portion. The scrubbing head is angularly adjustable with respect to the handle portion. A scrubbing pad is releasably attached to the scrubbing head and a battery-powered reciprocating mechanism provides selective reciprocation of the scrubbing pad. The scrubbing head may be releasably locked at a desired angle. Additionally, the handle portion may include at least one telescoping member for adjusting a length of the handle portion. The reciprocating mechanism may be powered by a rechargeable battery. A charging dock may be provided for receiving the handle portion and recharging the rechargeable battery. Alternatively, or used in conjunction with the charging dock, an inductive charger may be provided for releasable attachment to the handle portion for recharging the rechargeable battery.

12 Claims, 9 Drawing Sheets

(56) References Cited

U.S. PATENT DOCUMENTS

| | | | | |
|---|---|---|---|---|
| 10,575,703 | B2 | 3/2020 | Harrington et al. | |
| 11,006,785 | B2 * | 5/2021 | Al Hamli | B25G 1/04 |
| 2006/0168746 | A1 | 8/2006 | Guyuron et al. | |
| 2006/0285910 | A1 | 12/2006 | Khubani | |
| 2007/0234497 | A1 | 10/2007 | Lee | |
| 2011/0188923 | A1 * | 8/2011 | Lafleur | A46B 15/0055 403/53 |
| 2013/0060176 | A1 | 3/2013 | Nichols | |
| 2015/0342422 | A1 | 12/2015 | Firestone | |
| 2017/0112333 | A1 | 4/2017 | McCauley | |
| 2017/0211614 | A1 | 7/2017 | Knight | |
| 2017/0332850 | A1 * | 11/2017 | Powell | A47K 7/043 |
| 2020/0001329 | A1 | 1/2020 | Brennan | |
| 2020/0187635 | A1 | 6/2020 | Akridge | |
| 2020/0288919 | A1 | 9/2020 | Al Hamli | |
| 2020/0290094 | A1 | 9/2020 | Al Hamli | |

OTHER PUBLICATIONS

"EASACE Body Brush for Back, Long Handle Bath Brush for Showering, Adjustable Head Back Scrubber, Shower 2 Brush with Soft Bristles for Wet or Dry"; printed on Jan. 2, 2024 from https://www.amazon.com/EASACE-Showering-Adjustable-Scrubber-Bristles/dp/B0C2P3F54W/ref=psdc_11056501_t1_B09SFZBDY7.

* cited by examiner

SCRUBBING DEVICE WITH ADJUSTABLE HEAD

BACKGROUND

Field

The disclosure of the present patent application relates to cleaning devices, and particularly to a powered scrubbing device for bathing the body.

Description of Related Art

Many people have difficulty reaching much of their bodies while bathing. A wide variety of body brushes and back scrubbers are commercially available to combat this problem. These devices typically include an extended handle attached to a cleaning head. The cleaning head is typically a mesh cloth, a sponge or a soft brush and is arranged to scrub areas of one's body by manual manipulation of the entire device. However, many people with limited flexibility, strength and/or movement, such as due to a debilitating physical condition, find these cleaning products difficult to use. In addition, these products may drastically increase cleaning time, thus resulting in unnecessary fatigue. Furthermore, current powered body brushes are large, heavy and only offer a 360° rotating pad movement mechanism, making these devices difficult to handle, and are also limited with regard to reaching all of the bather's body parts. Thus, a scrubbing device with an adjustable head solving the aforementioned problems is desired.

SUMMARY

The scrubbing device with an adjustable head includes a handle portion and a scrubbing head attached to the handle portion. The scrubbing head is angularly adjustable with respect to the handle portion. A scrubbing pad is releasably attached to the scrubbing head and a battery-powered reciprocating mechanism provides selective reciprocation of the scrubbing pad. The scrubbing head may be releasably locked at a desired angle to help users easily reach body parts, such as, but not limited to, the back, the bottom of the foot, etc. Additionally, the handle portion may include at least one telescoping member for adjusting a length of the handle portion. An adjustment portion may be positioned between the handle portion and the scrubbing head for receiving, at least in part, the mechanism for angularly adjusting and locking the scrubbing head. The adjustment portion may have a flexible covering or housing. A front portion of the scrubbing head may have a substantially V-shaped contour, allowing the scrubbing pad to be stably angled (in either direction) to match the angles required for scrubbing sharply curved areas of the body, such as, but not limited to, the armpits, the crotch, the buttocks, etc.

The reciprocating mechanism may be powered by a rechargeable battery, which may be received within the handle portion. A charging dock may be provided for receiving the handle portion and recharging the rechargeable battery. Alternatively, or used in conjunction with the charging dock, an inductive charger may be provided for releasable attachment to the handle portion for recharging the rechargeable battery. In addition to one or more electronic controls, an indicator light or the like may be provided to indicate the remaining battery life, the charging state of the device, a warning that that the battery requires recharging, etc.

The scrubbing head may include a mounting member for releasable attachment to the scrubbing pad. The scrubbing pad may include a spine having a central hub adapted to be attached to the mounting member and a plurality of fingers extending radially from the central hub. The spine may further include a pair of diametrically opposed planar stabilizing members extending radially from the central hub and adapted to be aligned with a longitudinal axis of the handle portions. The stabilizing members may define a midline of the spine, and first and second halves of the plurality of fingers may respectively extend from opposed first and second sides of the midline of the spine.

These and other features of the present subject matter will become readily apparent upon further review of the following specification.

BRIEF DESCRIPTION OF DRAWINGS

Similar reference characters denote corresponding features consistently throughout the attached drawings.

DETAILED DESCRIPTION

Figure 1:
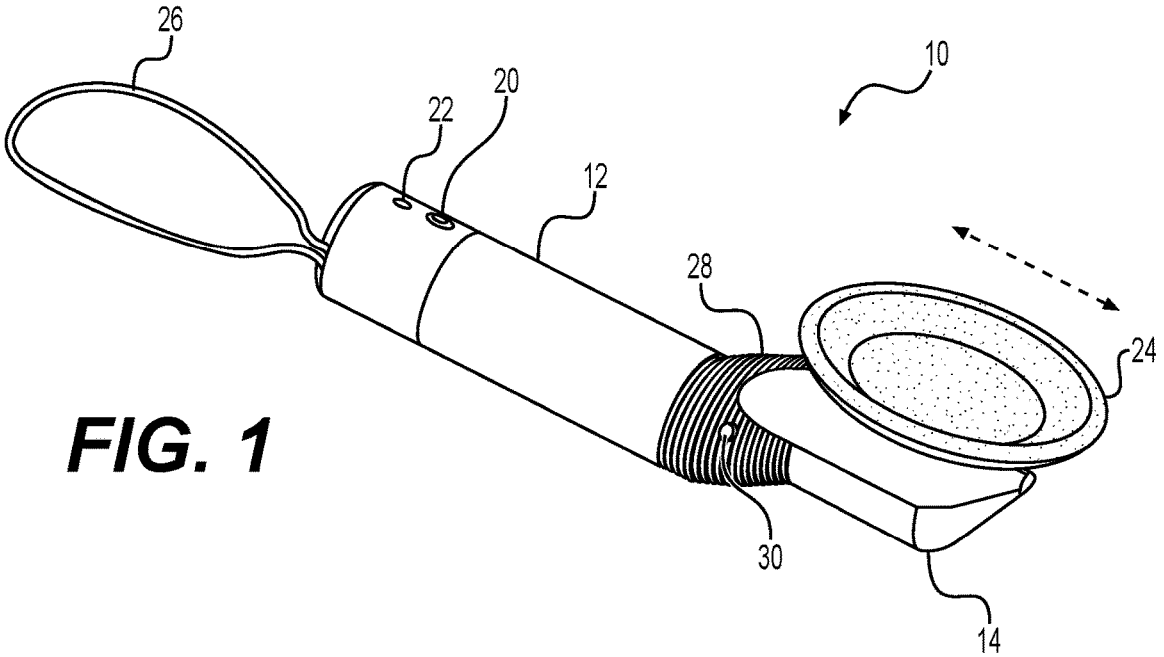
FIG. 1 is a perspective view of the scrubbing device with an adjustable head.
Figure 2:
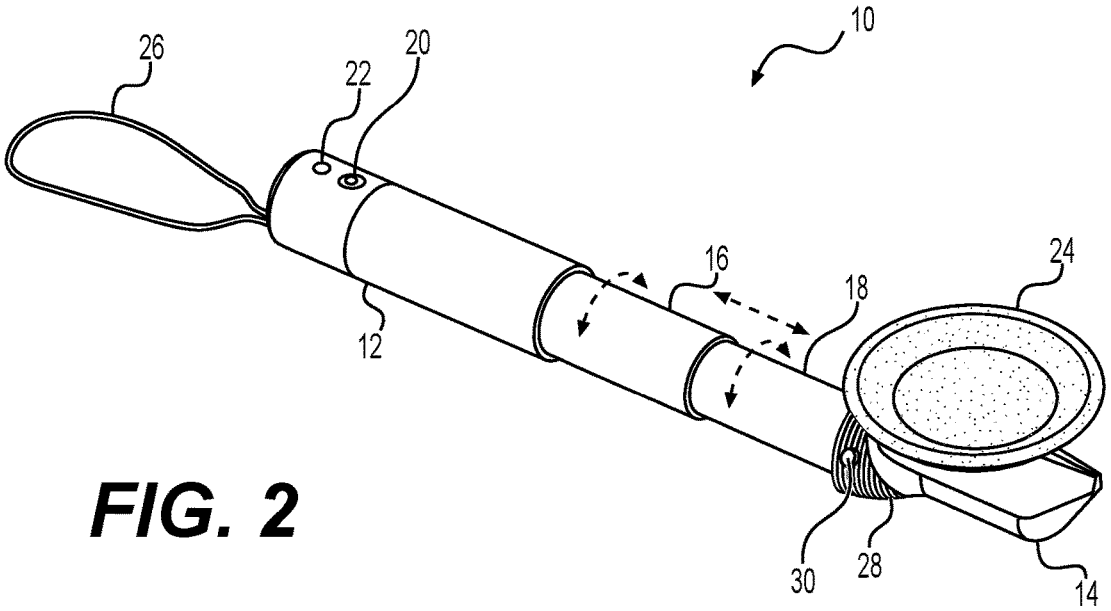
FIG. 2 is a perspective view of the scrubbing device with an adjustable head, shown in an extended configuration.

As shown in FIGS. 1 and 2, the scrubbing device with an adjustable head 10 includes a handle portion 12 and a scrubbing head 14. As seen in FIG. 2, the handle portion 12 may be connected to the scrubbing head 14 by multiple concentric tubular members 16, 18, which provide for telescopic lengthening of the scrubbing device with an adjustable head 10. Extension or deployment of the telescoping, concentric tubular members 16, 18 may be actuated using any suitable method. As a non-limiting example, a twisting motion of the handle portion 12 may extend the tubular members 16, 18 to lengthen the scrubbing device with an adjustable head 10. The handle portion 12 may support a first button 20 and a second button 22. The first button 20 may act as an on/off toggle switch for a reciprocator housed within the handle portion 12, and the second button 22 may adjust a reciprocating speed. A scrubbing pad 24 or other cleaning accessory may be removably attached to the scrubbing head 14. A safety loop 26 may be attached to the handle portion 12 for looping around the user's wrist. Further, in addition to buttons 20, 22, an indicator light or the like may be provided to indicate the remaining battery life, the charging state of the device, a warning that that the battery requires recharging, etc.

Figure 3A:
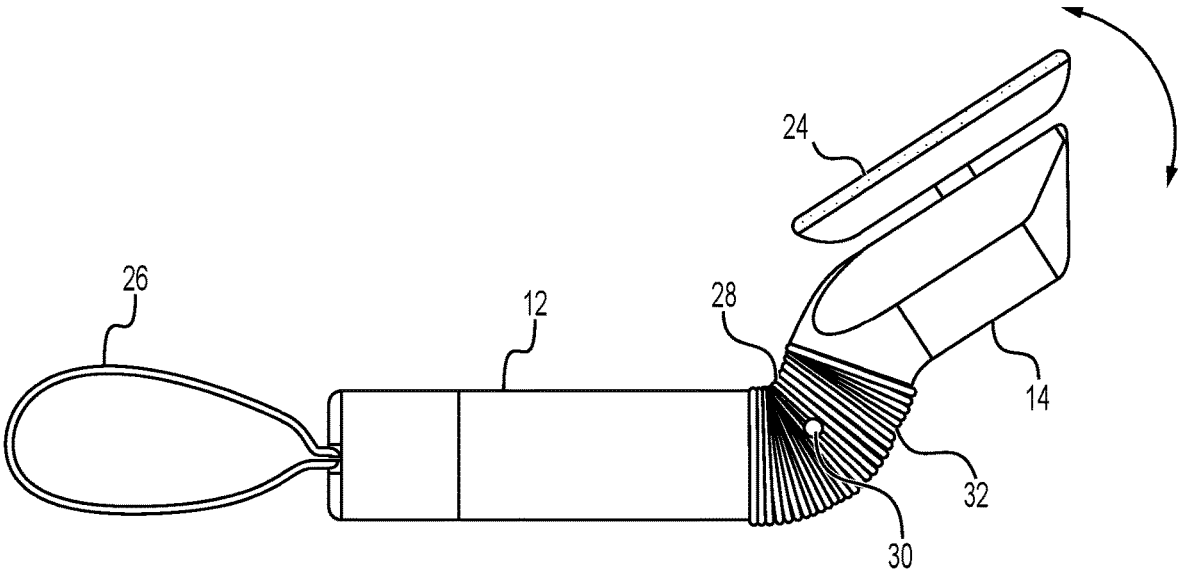
FIG. 3A and FIG. 3B are side views of the scrubbing device with an adjustable head, illustrating angular adjustment of the scrubbing head.
Figure 3B:
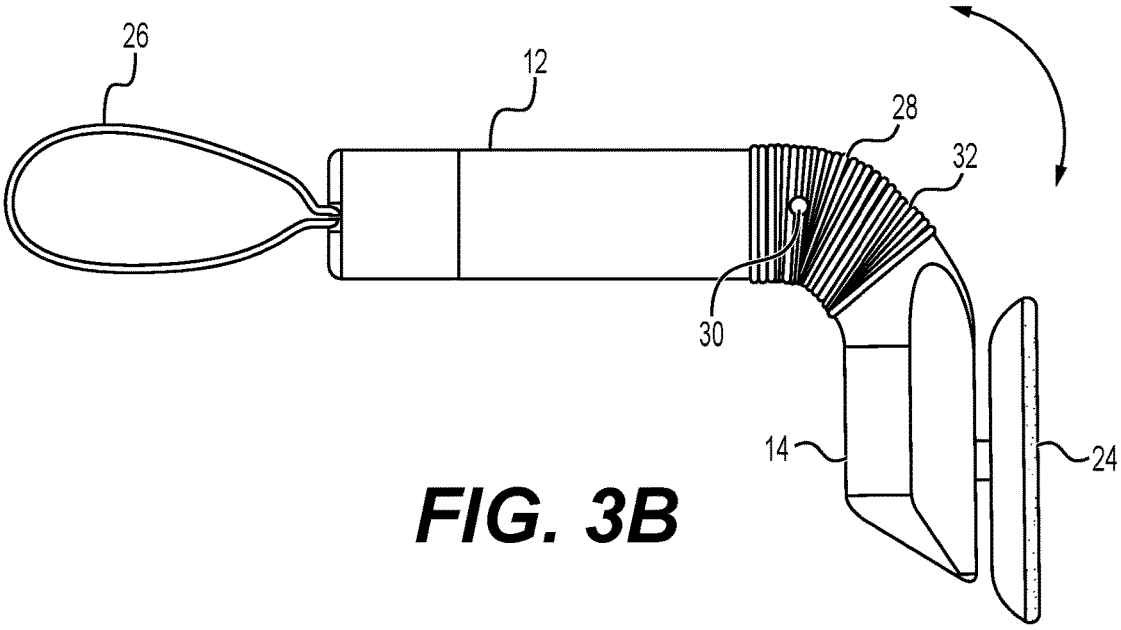

As best seen in FIGS. 3A and 3B, an adjustment portion is interposed between the handle portion 12 (or the telescoping, concentric tubular members 16, 18 when in the extended position of FIG. 2) and the scrubbing head 14. The user may press a third button 30 to release the scrubbing head 14 such that it may be freely rotatable and angularly adjustable with respect to the longitudinal axis of the handle portion 12. When the scrubbing head 14 is positioned at the desired angle, the user releases the third button 30 to lock the scrubbing head 14 in place at the desired angle to help users easily reach body parts, such as, but not limited to, the back, the bottom of the foot, etc. It should be understood that any suitable type of locking angular adjustment mechanism may be used, as is well known in the art. Examples of such locking angular adjustment mechanisms are shown in U.S. Pat. Nos. 5,123,768; 6,053,076; 7,082,862; 7,343,837; 7,72,287; 8,695,459; and 10,575,703; and U.S. Patent Publication Nos. 2007/0234497; and 2017/0211614, each of which is hereby incorporated by reference. Further, in FIGS. 3A and 3B, the locking angular adjustment mechanism is shown covered by a flexible covering or housing 32. It should be understood that this covering or housing 32 is shown for exemplary purposes only and that any suitable type of flexible cover may be used.

The handle portion 12 and the scrubbing head 14 of the scrubbing device with an adjustable head 10 may be made from any suitable type of shock resistant and waterproof material, such as a rigid polymer or the like, so that the device 10 maintains its form when exposed to the forces involved with scrubbing, as well as when it is dropped on hard surfaces. An outer layer of the handle portion 12 and/or the scrubbing head 14 may have an anti-shock coating made from rubber or silicone, as non-limiting examples. The outer layer may also provide a high friction surface to enhance the user's grip of the device 10 in wet and soapy environments. The handle portion 12 may also include any suitable type of seal(s) to provide a watertight barrier to prevent water from accessing the internal components of device 10.

The handle portion 12 and/or the scrubbing head 14 may contain a battery-powered and motor-driven reciprocation mechanism for providing reciprocating motion to the scrubbing head 14. It should be understood that any suitable type of reciprocation system may be used. An example of such a battery-powered and motor-driven reciprocation mechanism is shown in the inventor's previous U.S. Pat. No. 11,006,785 B2, which is hereby incorporated by reference in its entirety.

Figure 4A:
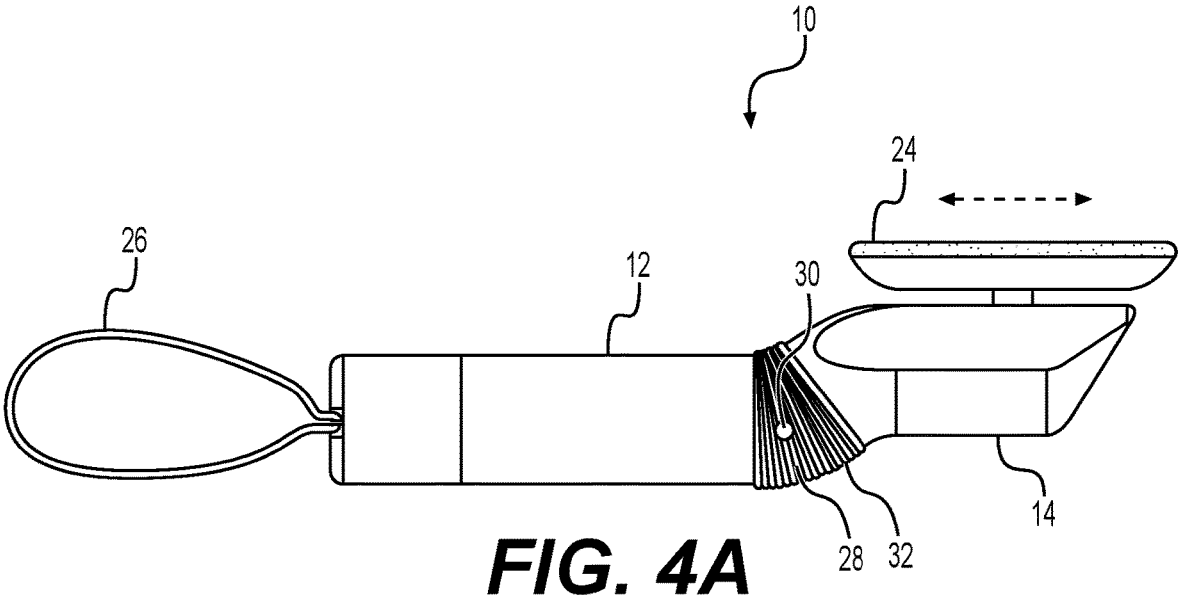
FIG. 4A is a side view of the scrubbing device with an adjustable head.
Figure 4B:
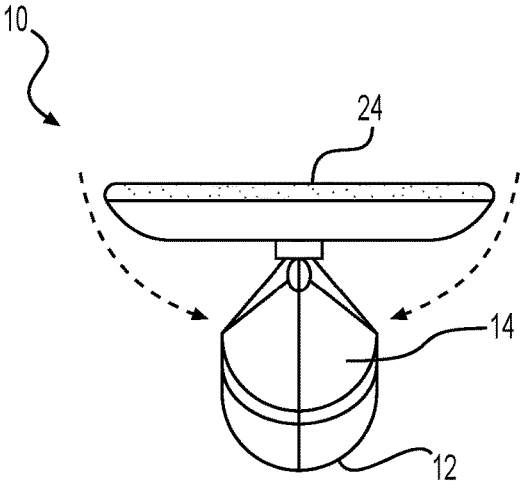
FIG. 4B is a top view of the scrubbing device with an adjustable head.

FIG. 4A shows the reciprocating motion path that may be imparted to the scrubbing pad 24. The reciprocator may reciprocate the scrubbing pad 24 along the direction of the longitudinal axis of the handle portion 12, for example. FIG. 4B shows the relation between the scrubbing pad 24 and the scrubbing head 14. The scrubbing pad 24 may be configured on the scrubbing head 14 to allow for greater flexion of the scrubbing pad 24 during use. For example, when scrubbing an armpit, the scrubbing head 14 may allow the scrubbing pad 24 to flex down for following the U-shaped contour of the armpit. It should be understood that any suitable type of flexible, pivotal and/or rotational joint or attachment between the scrubbing pad 24 and the scrubbing head 14 may be used. Further, as shown in FIG. 4B, the front portion of scrubbing head 14 may have a substantially V-shaped contour, allowing the scrubbing pad 24 to be stably angled (in either direction) to match the angles required for scrubbing sharply curved areas of the body, such as, but not limited to, the armpits, the crotch, the buttocks, etc.

Figure 5:
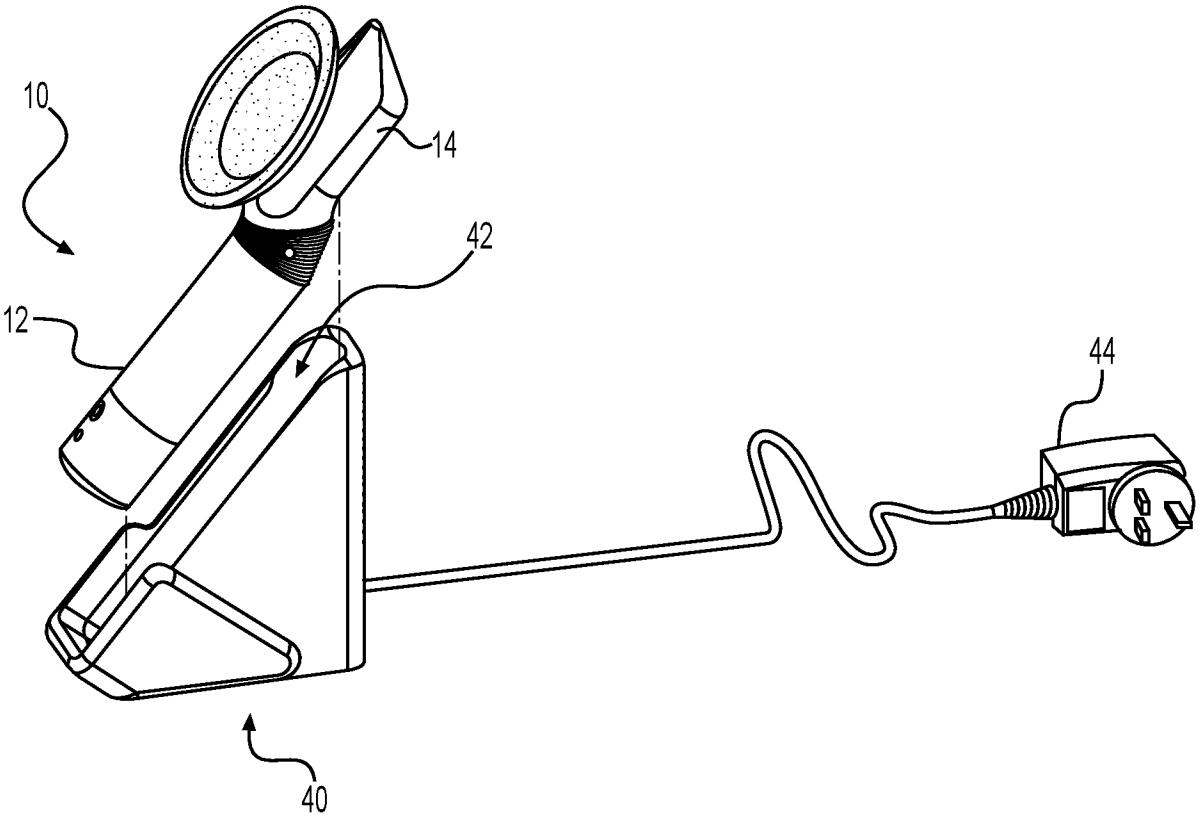
FIG. 5 is an exploded perspective view of the scrubbing device with an adjustable head being attached to a recharging dock.
Figure 6:
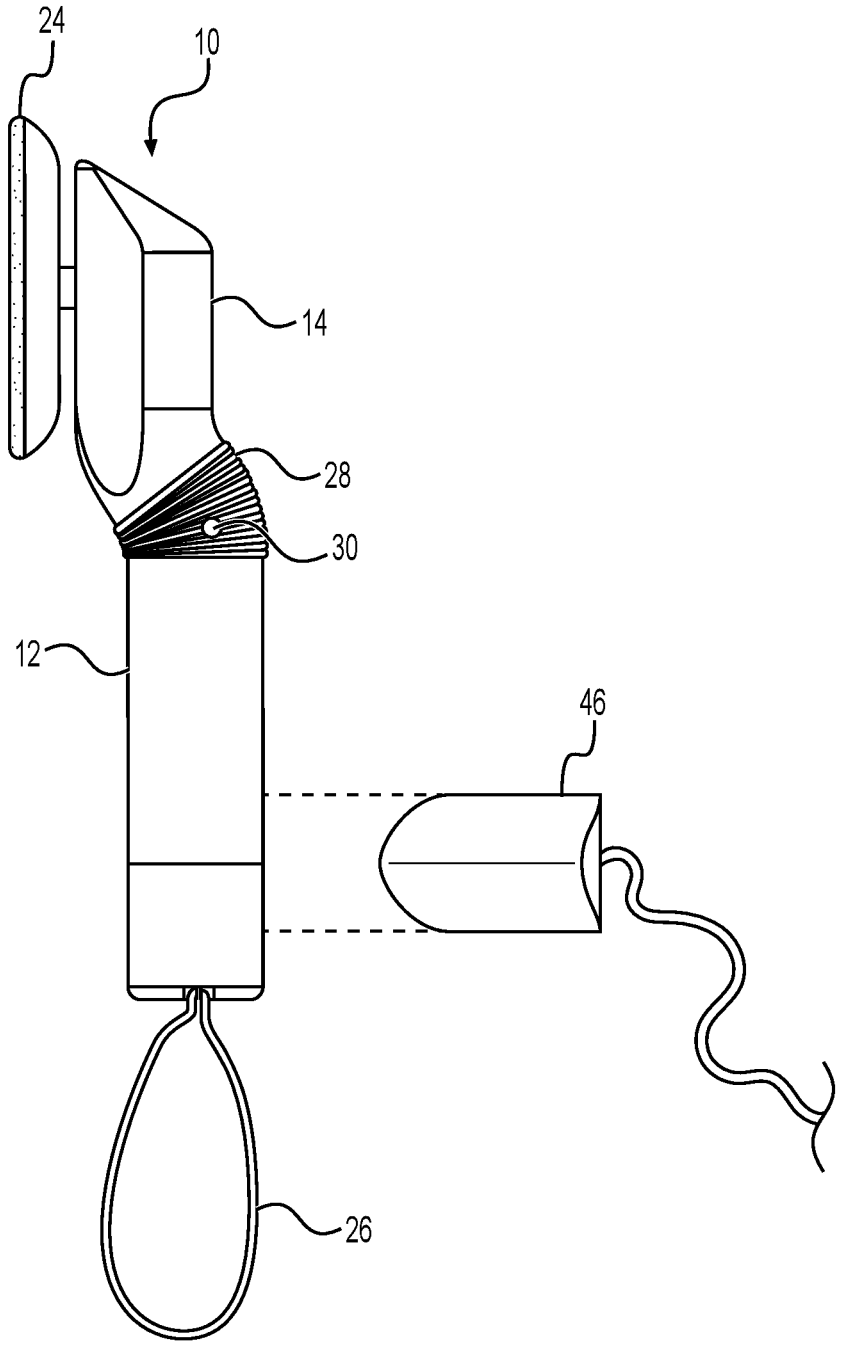
FIG. 6 is a side view of the scrubbing device with an adjustable head being attached to an inductive charger.
Figure 7A:
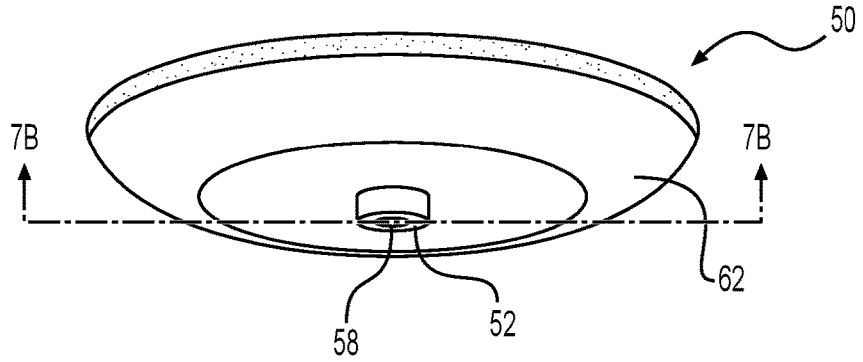
FIG. 7A is a perspective view of a scrubbing pad of the scrubbing device with an adjustable head.
Figure 7B:
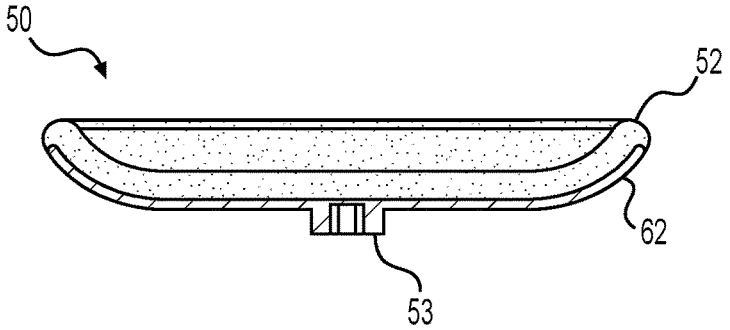
FIG. 7B is a cross-sectional view of the scrubbing pad, taken along cut lines 7B-7B in FIG. 7A.
Figure 7C:
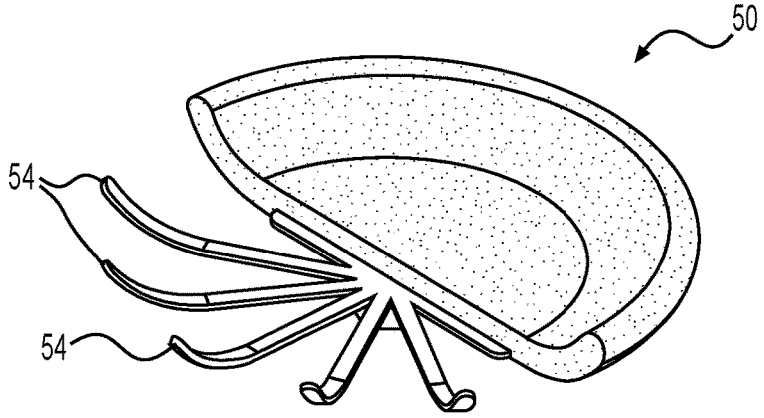
FIG. 7C is a partially cut-away, perspective view of the scrubbing pad of FIG. 7A.
Figure 7D:
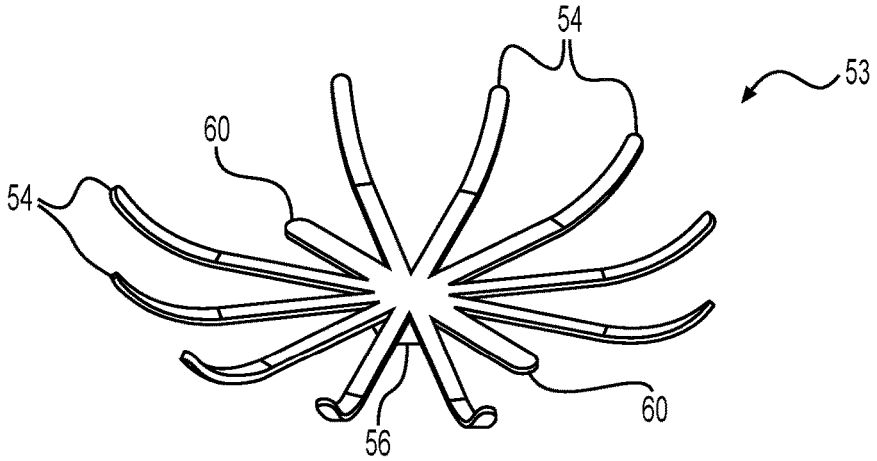
FIG. 7D is a perspective view of a base of the scrubbing pad of FIG. 7A.

FIG. 5 shows a charging dock 40 that may be used for recharging a battery contained in device 10 for powering the reciprocation mechanism. The charging dock 40 may include a docking port 42 for accepting and securing the handle portion 12 of the device 10. A magnetic connection may be provided between the device 10 and the charging dock 40 to further secure the two. When docked in the docking port 42, two electrodes on the device 10 may contact two electrodes on the charging dock 40 to provide an electrical connection between the battery and dock 40. A power cord 44 is provided for transmitting power from a wall outlet to the dock 40. The charging dock 40 may be water-resistant for use in a wet environment and/or for accepting a wet device 10. Alternatively, or used in conjunction with charging dock 40, an inductive charger 46 may be used to recharge the battery. As shown in FIG. 6, an inductive charger 46, as is well known in the art, may be secured to an exterior of device 10 using magnets or the like for inductively charging the battery.

FIGS. 7A-7D show a scrubbing pad 50 that may be mounted on the scrubbing head 14 of the device 10. The scrubbing pad 50 may include a concave scrubbing layer 52 supported by a fingered spine base 53. In the non-limiting example of FIGS. 7C and 7D, the spine base 54 is shown as having ten radially extending fingers 54, which support the scrubbing layer 52 while allowing the scrubbing pad 50 to conform to the contours of a human body, although it should be understood that any suitable number of fingers may be used. The fingers 54 may be made from a resilient flexible material, such as silicone as a non-limiting example. A central hub 56 of the spine may form a connection port 58 for connection to a mounting member in scrubbing head 14. The central hub 56 may be made from a rigid material, such as polyethylene, as a non-limiting example, to securely hold the scrubbing pad 50 in place under variable scrubbing speeds and pressures.

Two diametrically opposed stabilizing members 60 may extend radially outwards from the central hub 56. Half of the fingers 54 may extend out from one side of the stabilizing members 60 and the other half of the fingers 54 may extend out from the opposing side. When attached to the mounting member of scrubbing head 14, the stabilizing members 60 may be aligned with the longitudinal axis of handle portion 12. By aligning the stabling members 60 with the longitudinal axis, the fingers 54 are positioned for supporting the scrubbing layer 52 when it is flexed around the scrubbing head 14 during use. A shell 62 may cover the bottom of the scrubbing layer 52 and spine base 54.

Figure 8A:
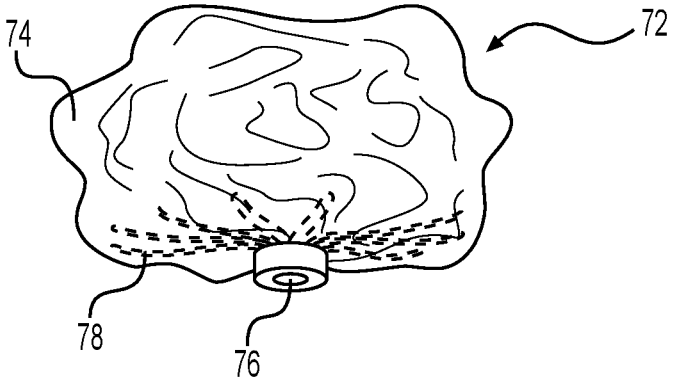
FIG. 8A is a perspective view of an alternative embodiment of the scrubbing pad, particularly showing a mesh scrubbing pad.

FIGS. 8A-8F show an embodiment of a kit of varying scrubbing pads 70*a*, 70*b*, 70*c*, 72, 80, 90 that may be used with the scrubbing device with an adjustable head 10. FIG. 8A shows a mesh sponge embodiment of the scrubbing pad 72. The mesh sponge scrubbing pad 72 may include an upper "pouf" mesh 74 supported by a fingered spine 78 having flexible fingers 78. The fingered spine 78 will support the mesh 74 in an upright position, while also allowing the mesh 74 to conform to the counters of the human body. A connection port 76 is provided for connection to scrubbing head 14, similar to connection port 58 of FIG. 7A.

Figure 8B:
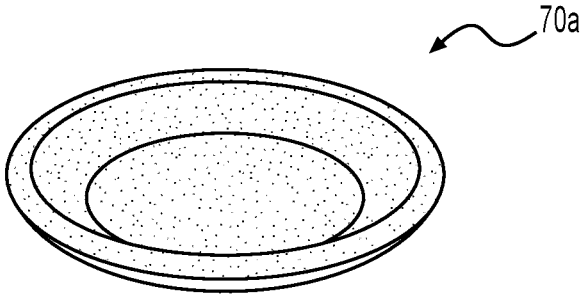
FIG. 8B is a perspective view of an alternative embodiment of the scrubbing pad, particularly showing a soft textured scrubbing pad.
Figure 8C:
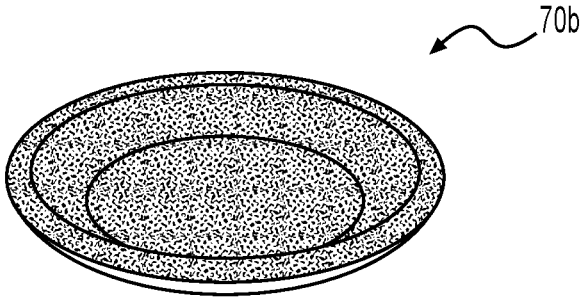
FIG. 8C is a perspective view of an alternative embodiment of the scrubbing pad, particularly showing a medium textured scrubbing pad.
Figure 8D:
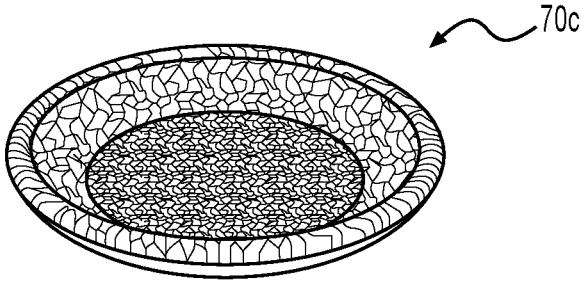
FIG. 8D is a perspective view of an alternative embodiment of the scrubbing pad, particularly showing a coarse textured scrubbing pad.
Figure 8E:
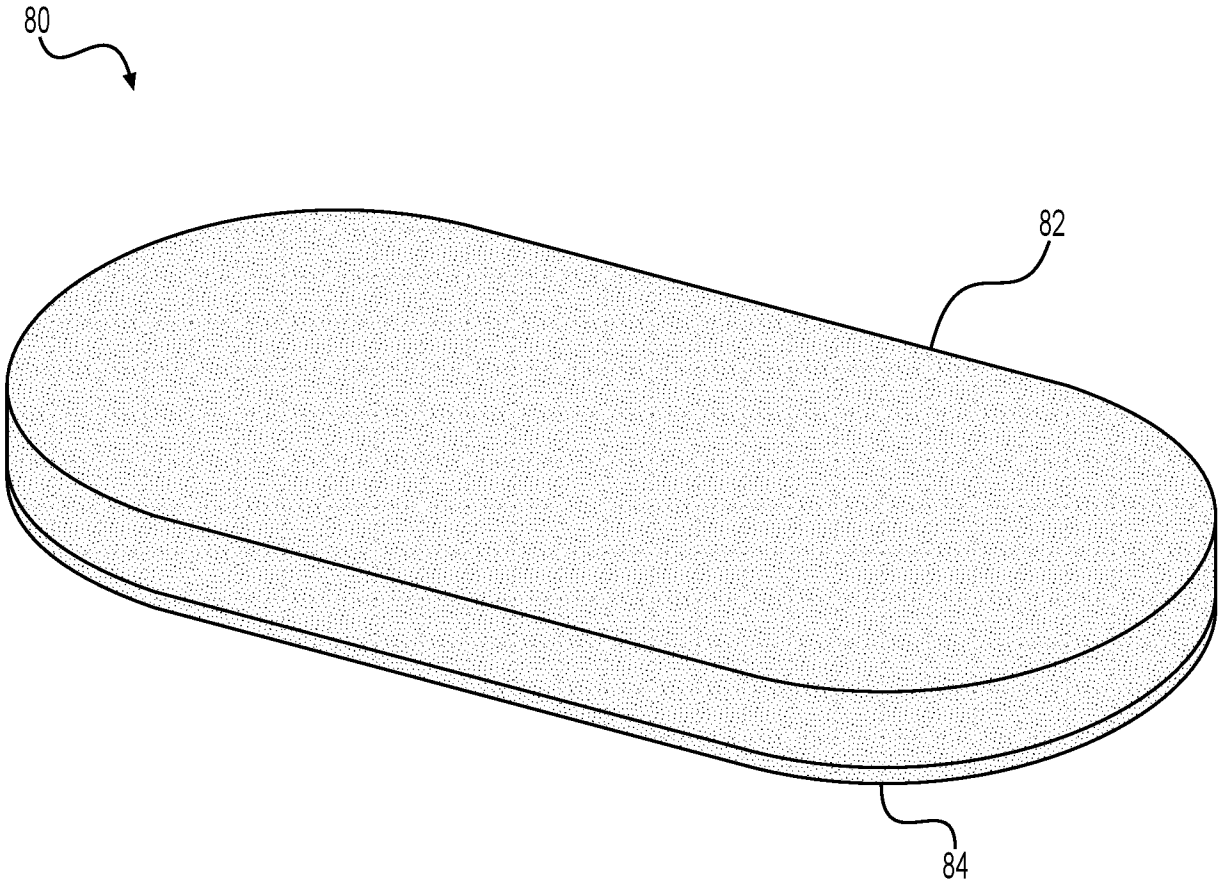
FIG. 8E is a perspective view of an alternative embodiment of the scrubbing pad, particularly showing a pumice stone scrubbing pad.
Figure 8F:
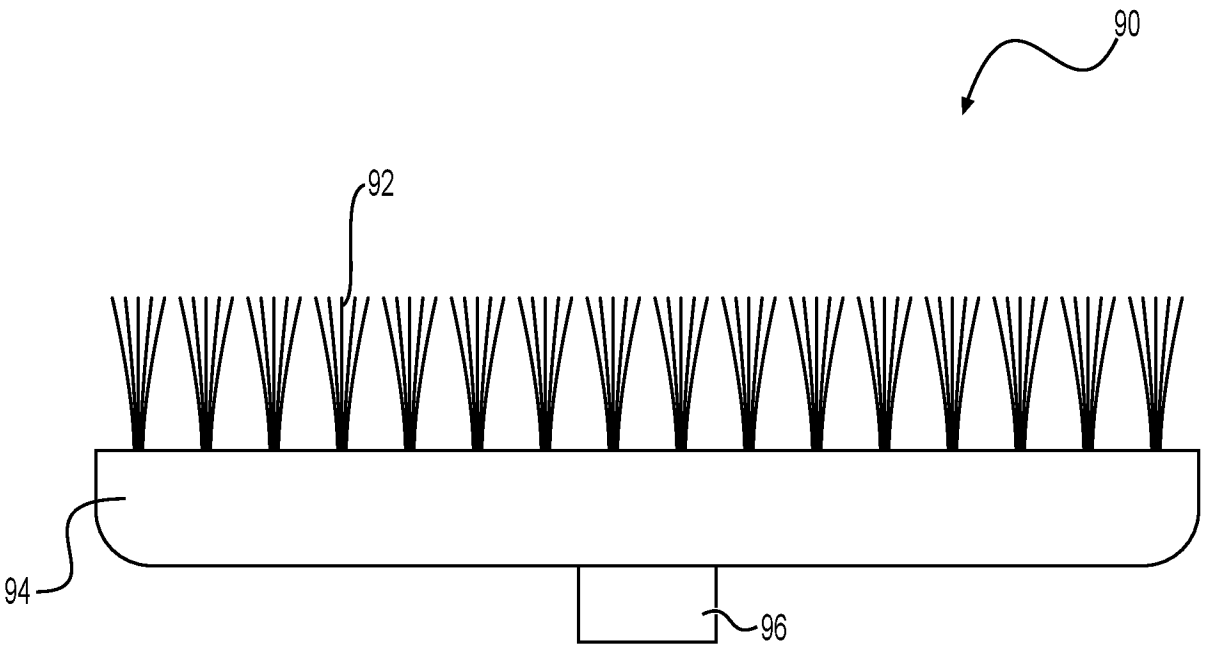
FIG. 8F is a side view of an alternative embodiment of the scrubbing pad, particularly showing a scrubbing brush.

FIGS. 8B, 8C and 8D show three varying embodiments of the scrubbing pad 50*a*, 50*b*, 50*c*, respectively, which provide varying degrees of exfoliation. FIG. 8B shows a soft-textured scrubbing pad 70*a*, FIG. 8C shows a medium-textured scrubbing pad 50*b*, and FIG. 8D shows a coarse-textured scrubbing pad 50*c*. FIG. 8E shows a pumice stone embodiment of the scrubbing pad 80 for removing dead skin from a user's foot. The pumice stone scrubbing pad 80 may include an upper pumice stone 82 supported by a lower base 84 having a connection port for connection to the scrubbing head 14. FIG. 8F shows a foot brush 90 for scrubbing a user's foot. The foot brush 90 may include a lower base 94 having a connection port 96 for connecting to the scrubbing head 14, and bristles 92 extending out from the base 822.

It is to be understood that the scrubbing device with an adjustable head is not limited to the specific embodiments described above, but encompasses any and all embodiments within the scope of the generic language of the following claims enabled by the embodiments described herein, or otherwise shown in the drawings or described above in terms sufficient to enable one of ordinary skill in the art to make and use the claimed subject matter.

The invention claimed is:

1. A scrubbing device with an adjustable head, comprising:

a handle portion;

a scrubbing head attached to the handle portion, wherein the scrubbing head is freely rotatable and angularly adjustable with respect to the longitudinal axis of the handle portion and is releasably lockable at a desired angle;

a button on the handle, the button being configured to release the scrubbing head for rotation and adjustment of the head with respect to the longitudinal axis of the handle portion;

a scrubbing pad releasably attached to the scrubbing head;

an adjustment portion positioned between the handle portion and the scrubbing head, wherein the adjustment portion comprises a tubular, flexible housing; and means for selectively reciprocating the scrubbing pad.

2. The scrubbing device with an adjustable head as recited in claim 1, wherein the handle portion comprises at least one telescoping member for adjusting a length of the handle portion.

3. The scrubbing device with an adjustable head as recited in claim 1, wherein the scrubbing head comprises a mounting member for releasable attachment to the scrubbing pad.

4. The scrubbing device with an adjustable head as recited in claim 3, wherein the scrubbing pad comprises a spine having a central hub adapted to be attached to the mounting member and a plurality of fingers extending radially from the central hub.

5. The scrubbing device with an adjustable head as recited in claim 4, wherein the spine further comprises a pair of diametrically opposed planar stabilizing members extending radially from the central hub and adapted to be aligned with a longitudinal axis of the handle portions.

6. The scrubbing device with an adjustable head as recited in claim 5, wherein the stabilizing members define a midline of the spine.

7. The scrubbing device with an adjustable head as recited in claim 6, wherein first and second halves of the plurality of fingers respectively extend from opposed first and second sides of the midline of the spine.

8. The scrubbing device with an adjustable head as recited in claim 1, wherein said means for selectively reciprocating the scrubbing pad comprises a rechargeable battery.

9. The scrubbing device with an adjustable head as recited in claim 8, further comprising a charging dock for receiving the handle portion and recharging the rechargeable battery.

10. The scrubbing device with an adjustable head as recited in claim 8, further comprising an inductive charger for releasable attachment to the handle portion for recharging the rechargeable battery.

11. The scrubbing device with an adjustable head as recited in claim 1, wherein at least a portion of the scrubbing head has a V-shaped cross-sectional contour.

12. The scrubbing device with an adjustable head as recited in claim 1, wherein the spine further comprises a pair of diametrically opposed planar stabilizing members extending radially from the central hub and adapted to be aligned with a longitudinal axis of the handle portions, and wherein the stabilizing members define a midline of the spine, and wherein first and second halves of the plurality of fingers respectively extend from opposed first and second sides of the midline of the spine.

* * * * *